US009228344B2

(12) United States Patent
Martigli

(10) Patent No.: US 9,228,344 B2
(45) Date of Patent: Jan. 5, 2016

(54) SYSTEM OF DISPOSABLE MOULDS USED TO MAKE-UP MODULAR FORMWORKS TO BUILD-UP CONCRETE WALLS FEATURING COMPLEX SHAPES

(76) Inventors: Massimo Martigli, Capraia e Limite (IT); Fabrizio Martigli, legal representative, Capraia e Limite (IT); Maddalena Martigli, legal representative, Capraia e Limite (IT); Monica Serafini, legal representative, Capraia e Limite (IT)

( * ) Notice: Subject to any disclaimer, the term of this patent is extended or adjusted under 35 U.S.C. 154(b) by 141 days.

(21) Appl. No.: 13/813,665

(22) PCT Filed: May 13, 2011

(86) PCT No.: PCT/IT2011/000150

§ 371 (c)(1),
(2), (4) Date: Feb. 15, 2013

(87) PCT Pub. No.: WO2012/017462

PCT Pub. Date: Feb. 9, 2012

(65) Prior Publication Data

US 2013/0140427 A1 Jun. 6, 2013

(30) Foreign Application Priority Data

Aug. 3, 2010 (IT) ..... FI2010A0169

(51) Int. Cl.
*E04B 1/16* (2006.01)
*E04B 2/86* (2006.01)

(52) U.S. Cl.
CPC ..... *E04B 2/8658* (2013.01); *E04B 2/8629* (2013.01); *E04B 2002/867* (2013.01); *E04B 2002/8676* (2013.01)

(58) Field of Classification Search
CPC ..... E04B 1/16; E04B 1/167; E04B 2/86; E04B 2/8605; E04B 2/8658; E04B 2/8694; E04B 2002/867; E04B 2002/8676
USPC ..... 52/439, 425
See application file for complete search history.

(56) References Cited

U.S. PATENT DOCUMENTS 5,473,850 A 12/1995 Balding

FOREIGN PATENT DOCUMENTS

FR 2582035 A1 11/1986
WO 00/28166 A1 5/2000

OTHER PUBLICATIONS

International Search Report issued in corresponding International Patent Application No. PCT/IT2011/000150 dated Sep. 12, 2011 (3 pages).

*Primary Examiner* — Michael Safavi
(74) *Attorney, Agent, or Firm* — Kilyk & Bowersox, P.L.L.C.

(57) ABSTRACT

System of disposable molds for the realization of modular formworks to contain and modelize vertical concrete castings, comprising one basic element and a plurality of special elements, such as to let a limited quantity of cement mixture come out, suitable for being spread on the formwork faces to trim it.

6 Claims, 22 Drawing Sheets

SYSTEM OF DISPOSABLE MOULDS USED TO MAKE-UP MODULAR FORMWORKS TO BUILD-UP CONCRETE WALLS FEATURING COMPLEX SHAPES

This application is a National Stage Application of PCT/IT2011/000150, filed May 13, 2011, which claims priority to Italian Patent Application No. FI2010A000169, filed Aug. 3, 2010.

TECHNICAL FIELD

The present invention relates to a system of disposable moulds for the realization of modular formworks to contain and modelize vertical concrete castings, possibly featuring complex shapes.

The system comprises one basic element and a number of special elements to realize openings for doors and windows, corners, intersections, housings for covering rafters and electrical devices, and whatever is necessary to implement formworks of any geometries.

BACKGROUND ART

There are different types of concrete walls commonly used in the civil work practice. Said walls are either prefabricated or realized with modular concrete elements pre-formed in a factory and subsequently masoned in a building yard.

The present invention is not part of the building technologies mentioned above, but relates to the building technology of the concrete walls cast in situ.

The concrete casting technique is known for a long time and is generally based on the use of a formwork, the purpose of which is to contain the concrete until it is sufficiently hardened, so as to get the appropriate structural resistance characteristics.

The purpose of a formwork is twofold: its first function is to give the desired geometric shape and dimensions to the casting, and the second one consists of the mechanical function of withstanding the hydrostatic pressure exerted by the liquid concrete and the solidification vibrations. Formworks can be classified into two main categories as follow: re-usable formworks, which generally consist of flat panels made of wood, metal, or other suitable materials, and disposable formworks.

Whenever a material is cast into a formwork that shall not be subsequently removed, but shall remain integral to the hardened cement, then we speak about disposable formwork.

In the building technique there are many examples of structures implemented using disposable formworks, including different types of foundation piles and retaining walls; modular elements, called moulds, are also known, each having dimensions substantially smaller than those of the handwork to be realized, by properly composing which formworks of the desired dimensions are made-up.

Disposable moulds are known to build-up small low-cost detached houses, typically but not exclusively for developing countries, formed of containing panels, which are assembled in the building yard to realize formworks designed to internally support the pipes of the hydraulic system and/or the cable ducts of the electrical system, including, for example, MX 2008011228 A or FR 2558868 (A1).

These solutions are uncomfortable in that they need the transportation of big-size elements and are also difficult to install, in that they need skilled and specialized operators to get the necessary alignments and perpendicularities of the moulds.

Ad-hoc special pieces are also necessary to realize doors and windows.

This is the reason why modular disposable moulds have been developed, as shown in FR 2618825, which allow to easily assemble formworks of different shapes and sizes, to realize the openings for doors and similar devices.

These modular disposable moulds are generally designed and developed in such a way as to be assembled together, while leaving ways through from one mould to the other internally thereto.

Thanks to said ways through, the cement mixture can spread from superimposed or partially superimposed modular moulds, as well as between adjacent modular moulds, in such a way as to make the concrete effectively cast internally to the formworks.

Unfortunately, the final appearance of the cement handworks obtained using disposable formworks of this type is very unpleasant, since the formworks, which remain visible; are aesthetically disagreeable and cannot be trimmed, for example by plastering them, because the plaster layer applied onto the outer surface of the formworks tends to come off and fold down, thus giving a very shabby appearance to the just made wall.

Furthermore, modular moulds are very expensive to transport, since the overall volume of the moulds is substantially equal to the overall volume of the finished walls.

OBJECTS AND BRIEF DESCRIPTION OF THE INVENTION

Therefore the main object of the present invention is to provide a complete and integrated system of add-on moulds, simple to use and inexpensive to implement, which allows to build formworks with the desired shapes and dimensions with openings for doors and windows, corners, housings for rafters and electrical devices, including switches and sockets, by also allowing an easy way through of the cement mixture between adjacent modular moulds and letting a limited quantity of cement mixture come off from the formworks for being spread onto the surfaces of the formworks, in such a way as to form a thin surface layer, both on the outer side and on the inner side of the just cast wall.

The surface layer thus obtained is well anchored to the wall because it forms one body with the concrete of the wall through the holes present in the outer faces of the modular mould, furthermore this layer is easy to trim and paint.

This and even further objects and advantages of the present invention that will become apparent to those expert in this matter from reading the following text, are basically obtained by using a modular formwork which is in turn obtained by using a plurality of types of disposable moulds of different shapes, all of these being modular and designed to be assembled each other.

Every type of disposable mould corresponds to a well defined function, for example an element to realize corners, an element to scarf cross partitions, an element to accommodate the controls of the electrical system, an element to accommodate the cover structure, etc.

The basic element of the disposable mould, preferably made of plastic material, is shaped like the side surface of a parallelepiped; in said side surface, normally formed of four faces, we identify two side coupling faces, opposite to each other, used to mate the side surfaces of other equal moulds, and two outer side faces, opposite to each other, used to make-up the outer faces of the formwork.

All types of moulds of the present invention are open above and below, to let the concrete go from up down and gradually fill all moulds that make-up the formwork; in order to facilitate the gradual filling of the complete formwork, each of the at least two side coupling faces of every mould comprises at least one hole to let the cement mixture also flow horizontally, not only vertically.

The outer side faces include a plurality of small holes, from which a limited quantity of cement mixture comes out during the casting process and is spread by an operator to make-up an outer coating of the formwork.

In order to be able to implement formworks featuring complex geometries, the system comprises different types of disposable moulds; in addition to the basic mould, a number of disposable moulds have been also designed to implement right corners, left corners, right and left partition scarves, half-moulds for a staggered mould assembling, entire moulds and half moulds for head-mounting, and moulds with a built-in housing for the covering structure or the electrical devices.

Having assembled the individual moulds so as to form an add-on formwork, but before the initial casting internally to the formwork, it is possible to lay, amongst others, the pipes of the hydraulic system and the cable ducts of the electrical system, the latter also in connection to the housings which a specific type of mould is already provided with.

In a preferred embodiment of the present invention, the outer side faces of the moulds include stiffening ribs on one only or both sides; said ribs, also advantageously perform the function of improving the anchoring of the cement layer that makes-up the outer coating.

By way of non-limiting example, without restricting the scope of the invention, in the attached figure said ribs are shown parallel to the edges of the disposable modular mould.

In order to connect to other equal moulds up and down, a female half-joint is located on the top of every mould, whereas a male half-joint is located in the lower part.

The upper female half-joint consists of a thin foil, which makes-up an extension toward the top of the outer faces of the side surface of the mould.

The lower male half-joint consists of a thin foil, which makes-up an extension toward the bottom of the inner faces of the side surface of the mould.

The thickness of the foils making-up the lower male half-joint and the upper female half-joint respectively is such that the male half-joint shall slightly force to enter the female half-joint, such a small interference being intentionally provided to hold the coupling firm even during the concrete casting process, so as to withstand the hydrostatic pressure and the solidification vibrations.

In order to make it possible to superimpose the modular moulds not only by holding them vertically aligned, but also when assembling them on rows with elements staggered from each other, the foil of the lower male half-joint is broken along those sections which make-up an extension of the outer faces; in this way, whenever a mould is placed across two moulds beneath, the foils of the upper female half-joint that come out from the coupling faces of the moulds beneath can be received by the cuts of the foils of the lower male half-joint of the mould above.

Even more advantageously, in order to be able to superimpose different moulds so as to form a straight angle between a mould beneath and the mould above, the cuts in the foil of the lower male half-joint are made at a distance from the coupling face which is substantially equal to the width of said coupling face.

In a particularly advantageous embodiment, the present invention also makes it possible to have the moulds transported to the building yard in a particularly inexpensive and convenient way, in that the volume occupied by them during the transportation is negligible with respect to the overall volume of the finished walls and is comparable to the volume occupied by non-modular disposable moulds.

This result is achieved by building each element of the system of disposable moulds as a molded element made of a plastic material, featuring a substantially flat shape, comprising the different faces of the side surface of the element connected to each other by laminar hinges.

In particular, the basic element is obtained from a flat molded element, comprising the four faces of the side surface of the parallelepiped, aligned and arranged two by two, connected to each other by laminar hinges formed during the molding process.

In the building yard, the individual disposable moulds are first re-shaped, by turning the faces by a straight angle around said laminar hinges, and then assembled, by connecting them to other moulds to form the formwork.

Along the two terminal edges of the molded element, which will assume a vertical position after assembling the mould, locking-in facilities are arranged, which allow to join the first and the last face to each other, so as to form a straight angle and thus close the mould.

The disposable mould realized according to this configuration is delivered to the building yard stacked, consequently it occupies a very little volume, then it is mounted and finally assembled together with other moulds of the same type to form a formwork having the desired shape and dimensions. The remaining elements of the system of disposable moulds can also be realized by molding a plastic material, so as to form a substantially flat element in which the individual faces are joined together by laminar hinges.

The formworks can be directly assembled on any surfaces, preferably with an anchoring system.

The advantages of the present invention will become more readily apparent, along with its technical characteristics, from the following detailed description, of an embodiment that is described by way of an example without restricting the scope of the invention.

Figure 1:
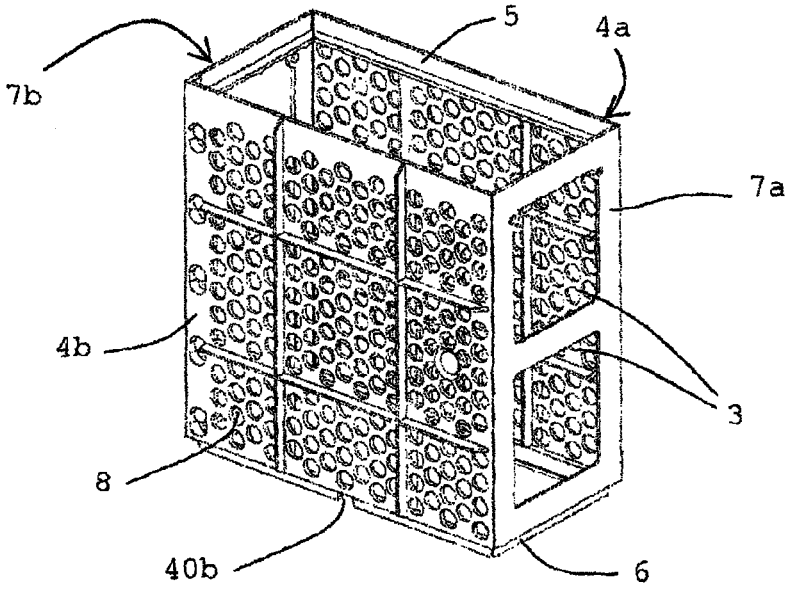
FIG. 1 shows the basic element closed.
Figure 2:
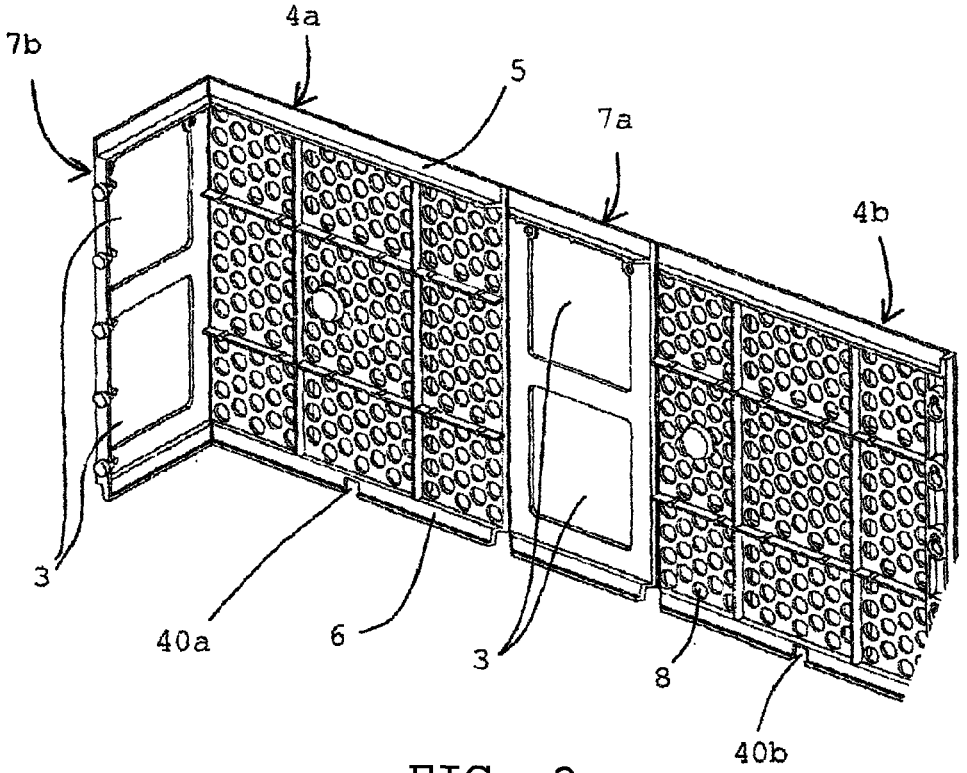
FIG. 2 shows the basic element completely opened, before starting its mounting.
Figure 3:
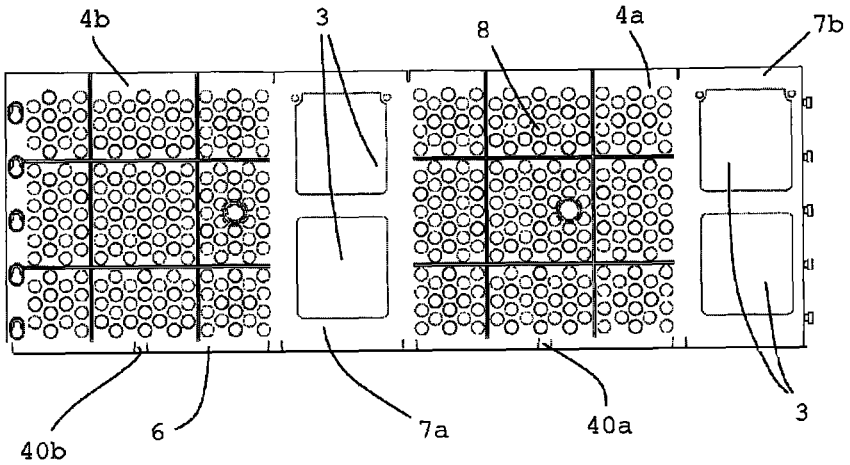
FIG. 3 shows the basic element during the mounting operation, after turning one of the side jointing faces by 90°.
Figure 4:
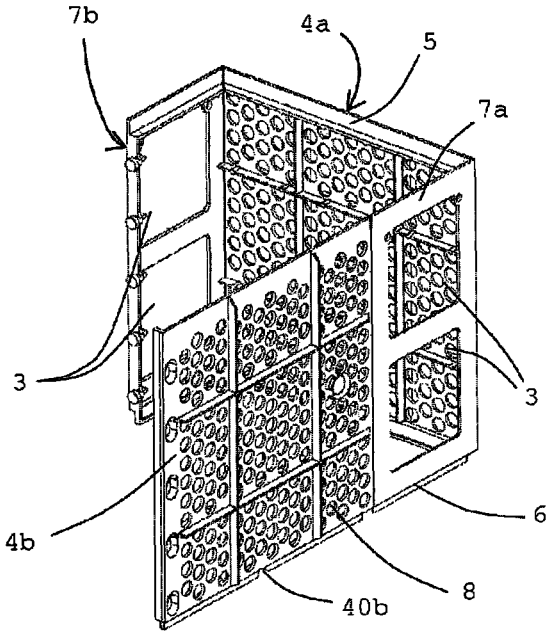
FIG. 4 shows a mounting step more advanced than that shown in FIG. 3.
Figure 5:
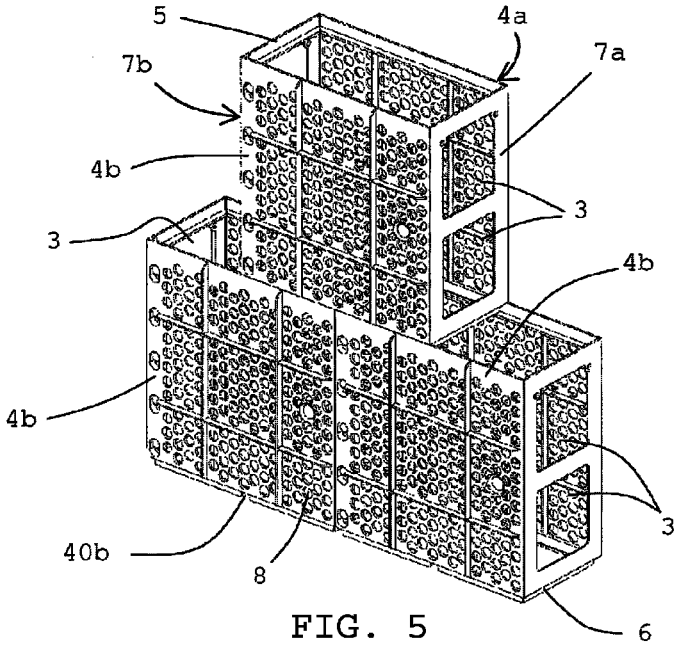
FIG. 5 shows a portion of rectilinear formwork, formed of three basic elements assembled together on two superimposed rows, so as to stagger the joints.
Figure 6A:
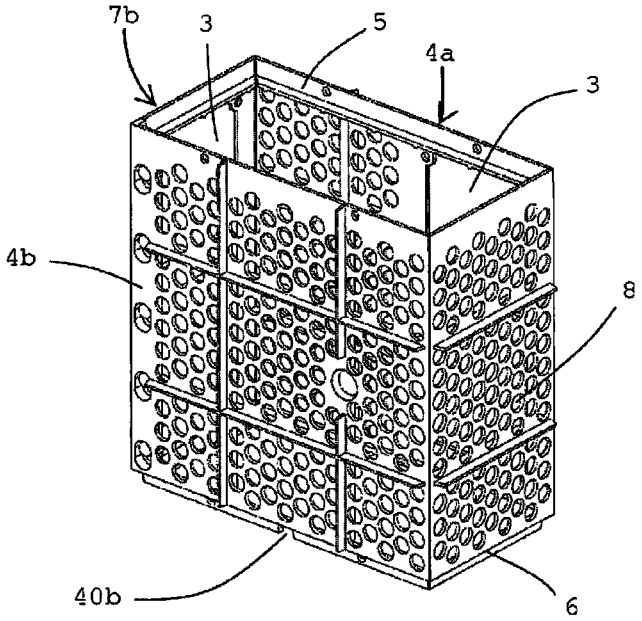
FIG. 6*a* shows a left angular element completely mounted and ready for being assembled together with other elements.
Figure 6B:
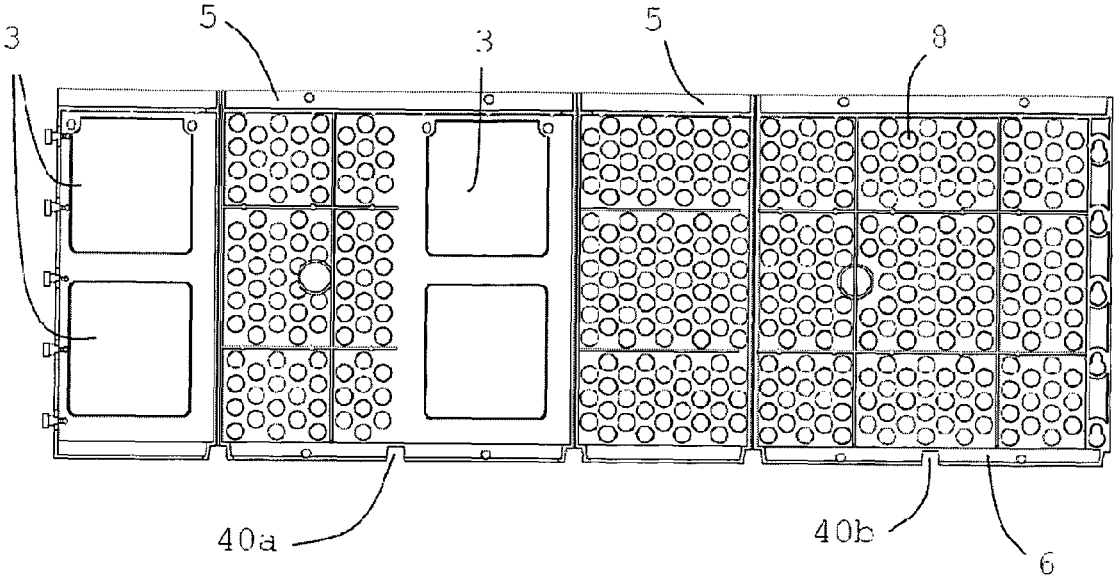
FIG. 6*b* shows a left angular element completely opened, before starting its mounting operation.
Figure 6C:
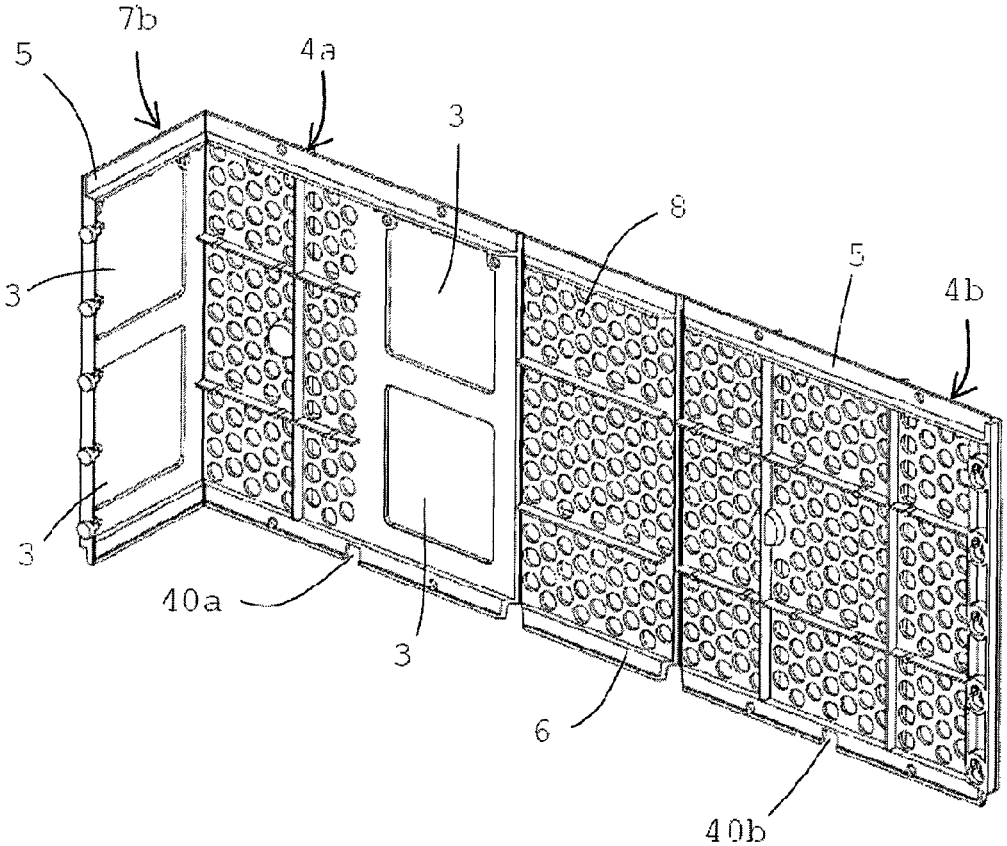
FIG. 6*c* shows a left angular element partially mounted.
Figure 6D:
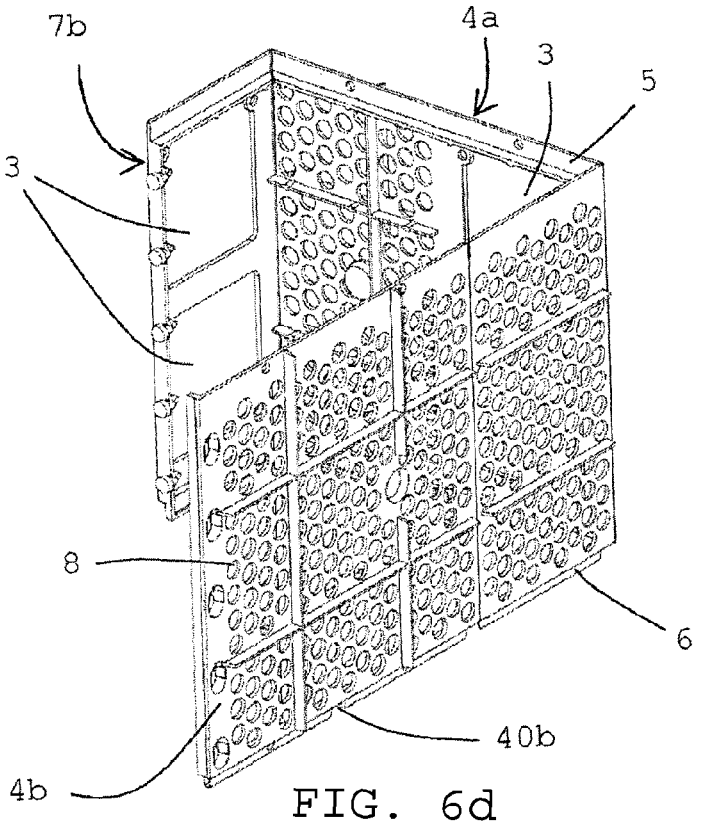
FIG. 6*d* shows a left angular element almost completely mounted.
Figure 7A:
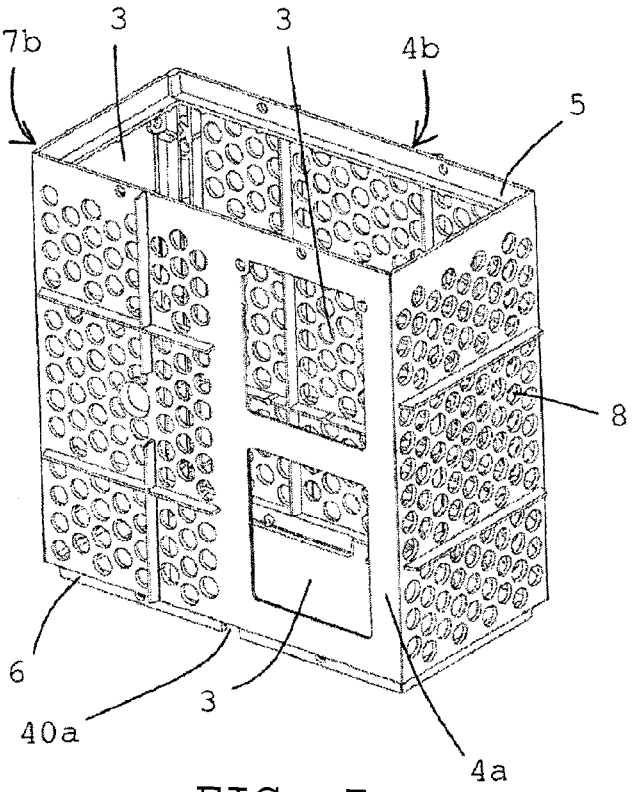
FIG. 7*a* shows a right angular element completely mounted and ready for being assembled together with other elements.
Figure 7B:
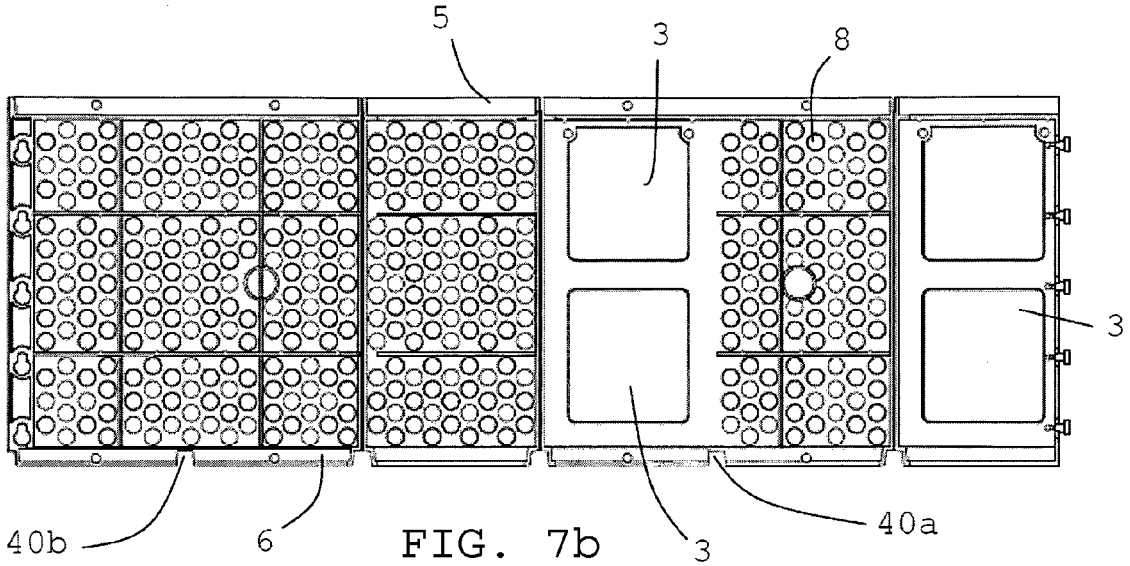
FIG. 7*b* shows a right angular element completely opened, before starting its mounting.
Figure 7C:
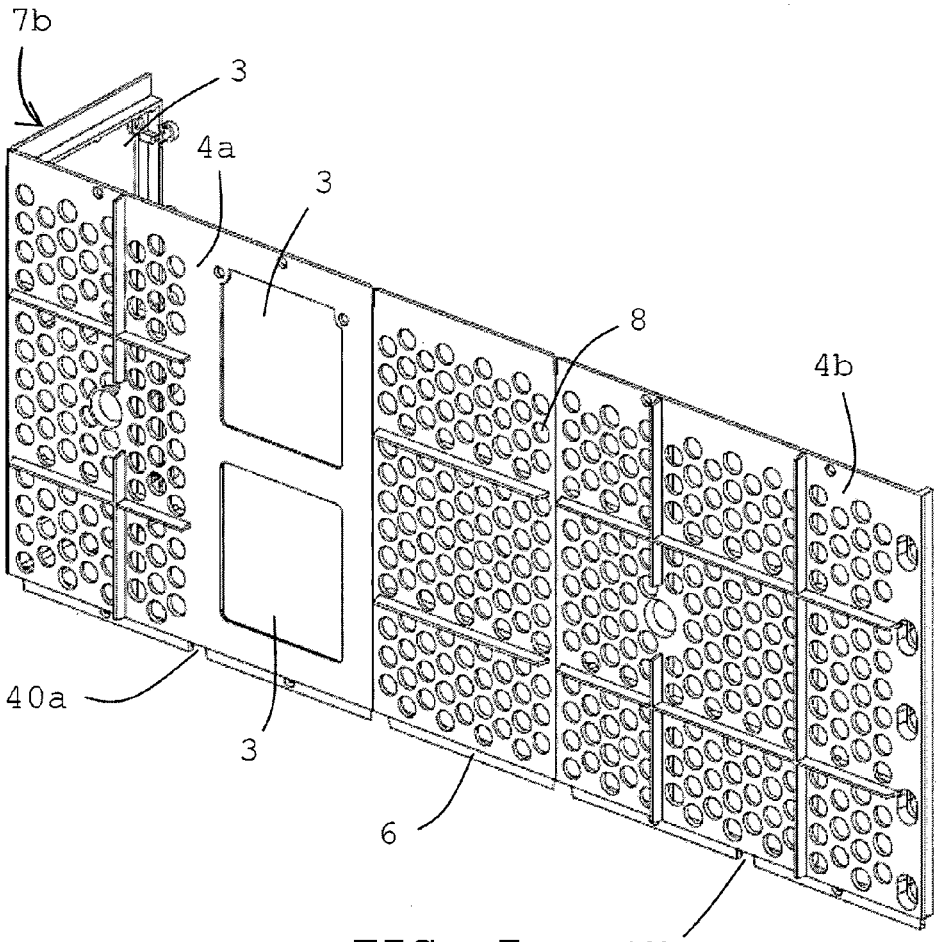
FIG. 7*c* shows a right angular element partially mounted.
Figure 7D:
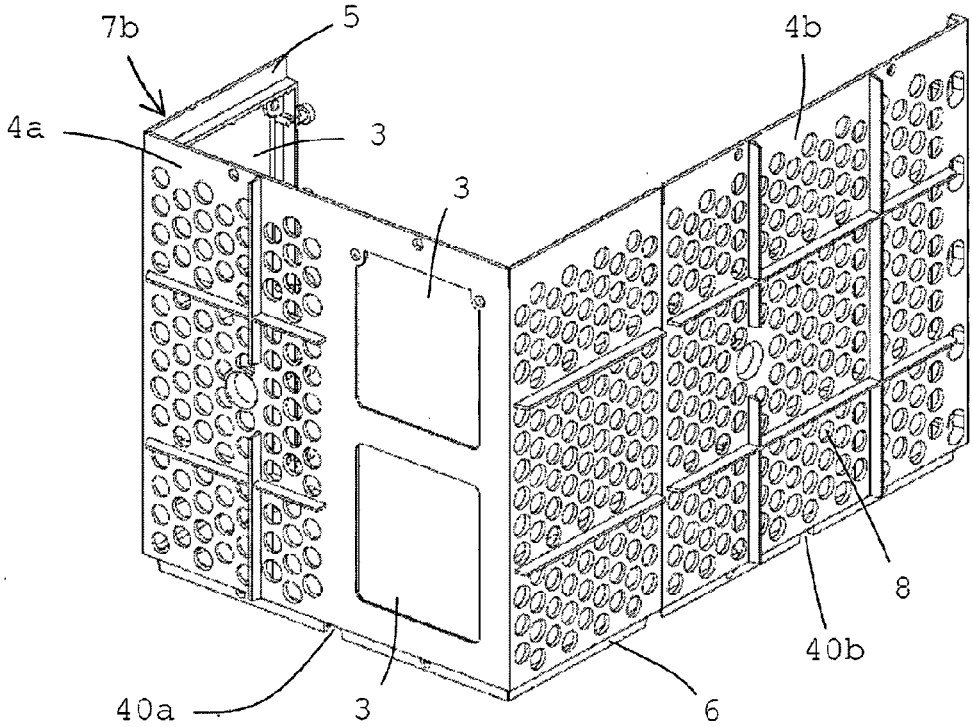
FIG. 7*d* shows a right angular element almost completely mounted.
Figure 8:
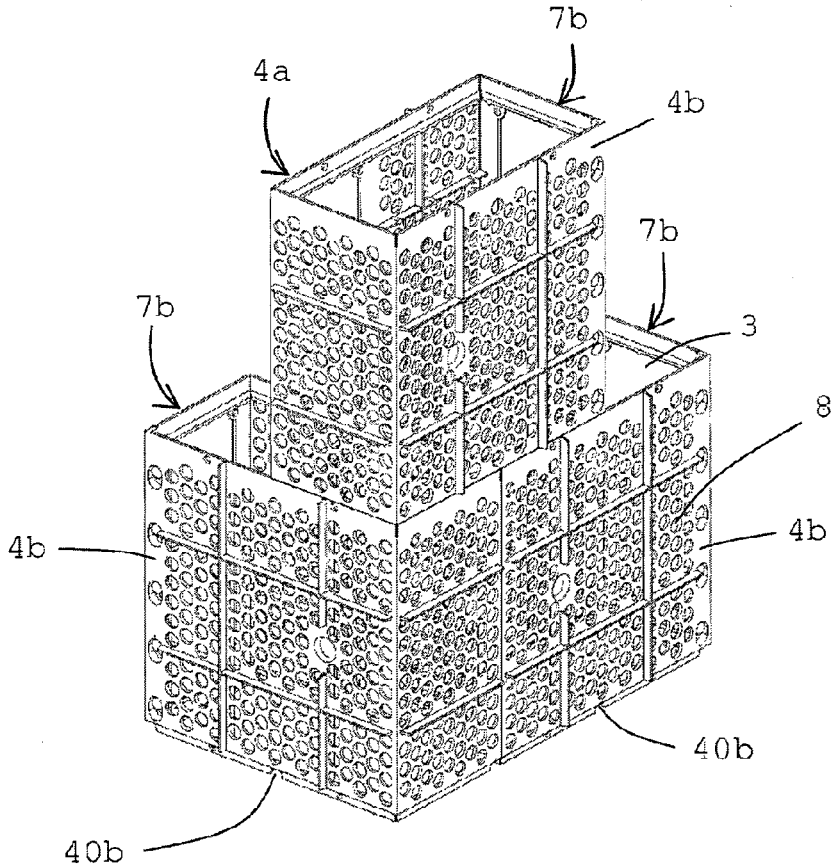
FIG. 8 shows an example of assembling of the right angular element, the left angular element, and the basic element, so as to form a small piece of formwork and realize two walls at a right angle to each other.
Figure 9A:
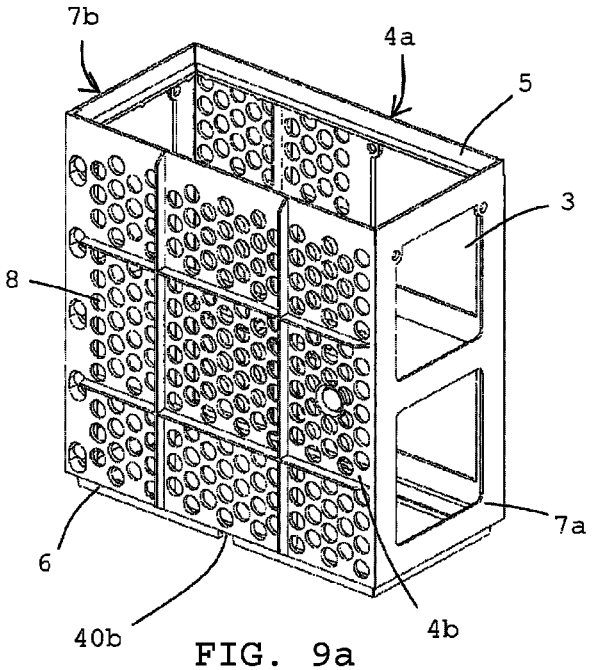
FIG. 9*a* shows a left partition element completely mounted and ready for being assembled together with other elements.
Figure 9B:
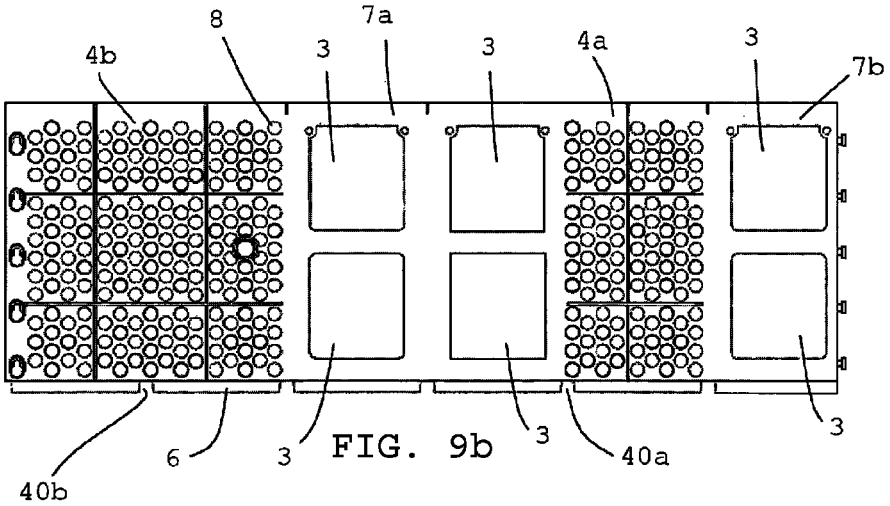
FIG. 9*b* shows a left partition element completely opened, before starting its mounting.
Figure 9C:
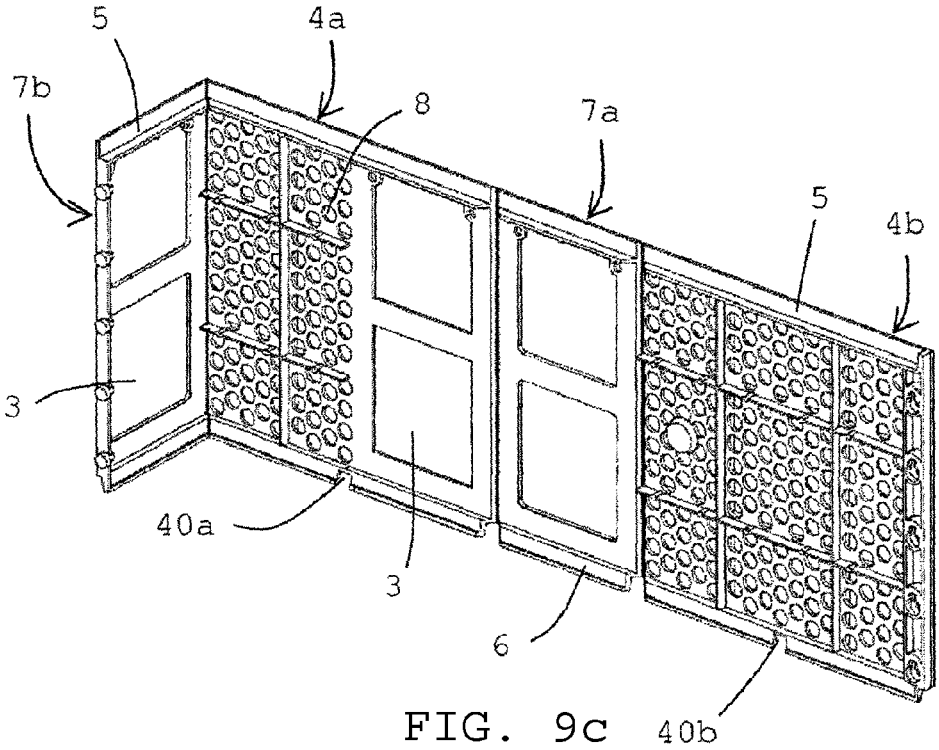
FIG. 9*c* shows a left partition element partially mounted.
Figure 9D:
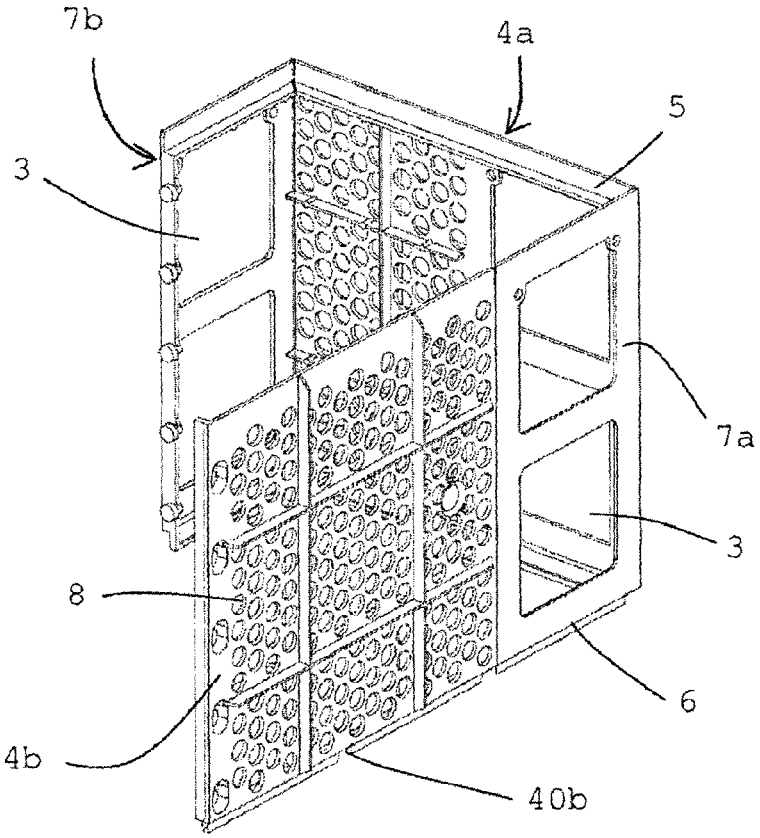
FIG. 9*d* shows a left partition element almost completely mounted.
Figure 10A:
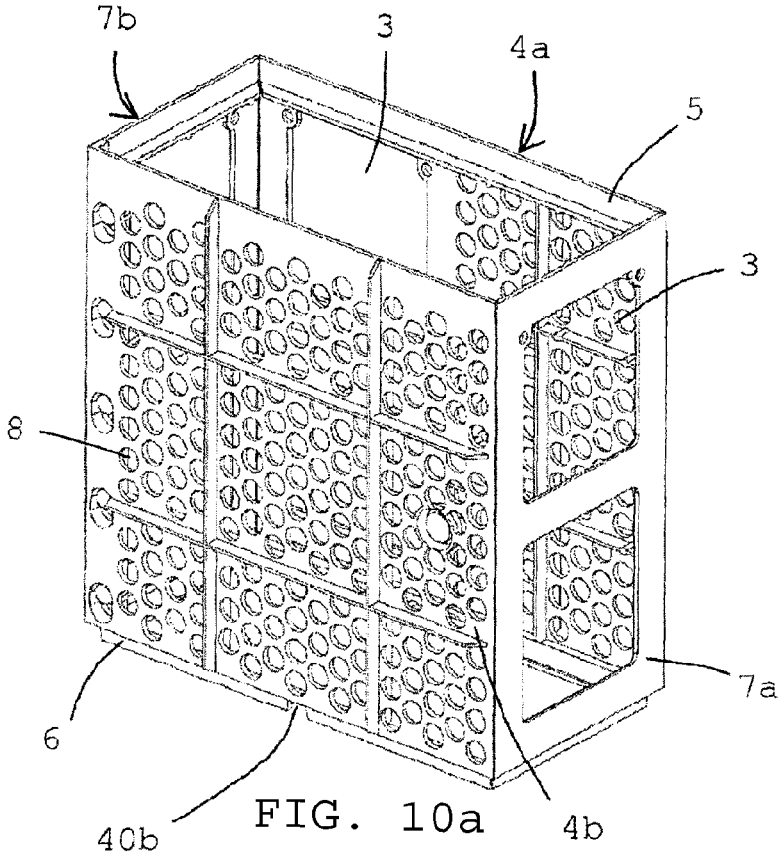
FIG. 10*a* shows a right partition element completely mounted and ready for being assembled together with other elements.
Figure 10B:
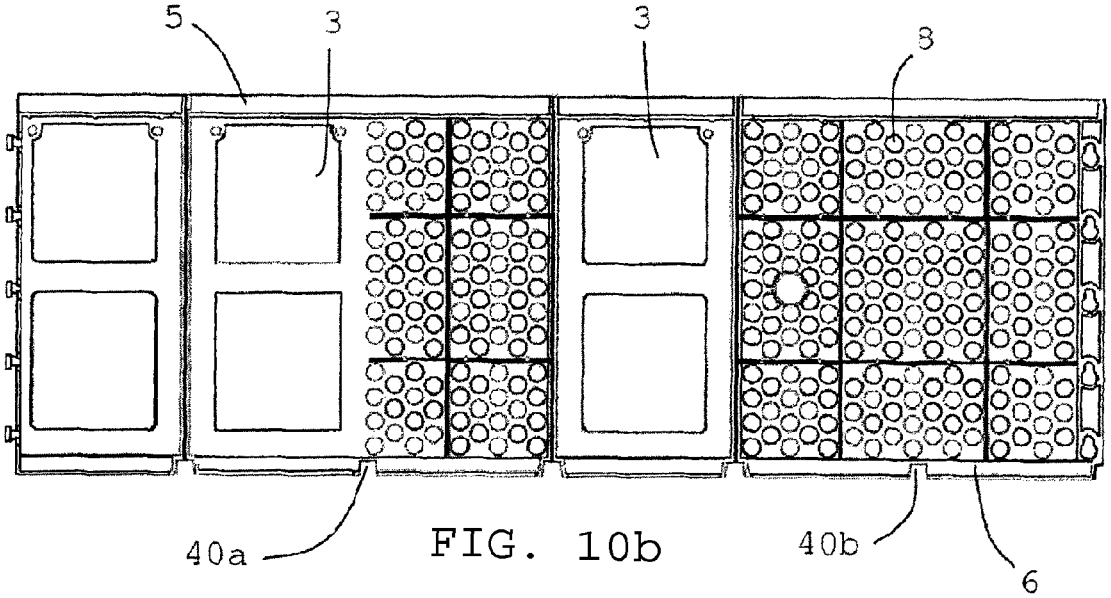
FIG. 10*b* shows a right partition element completely opened, before starting its mounting.
Figure 10C:
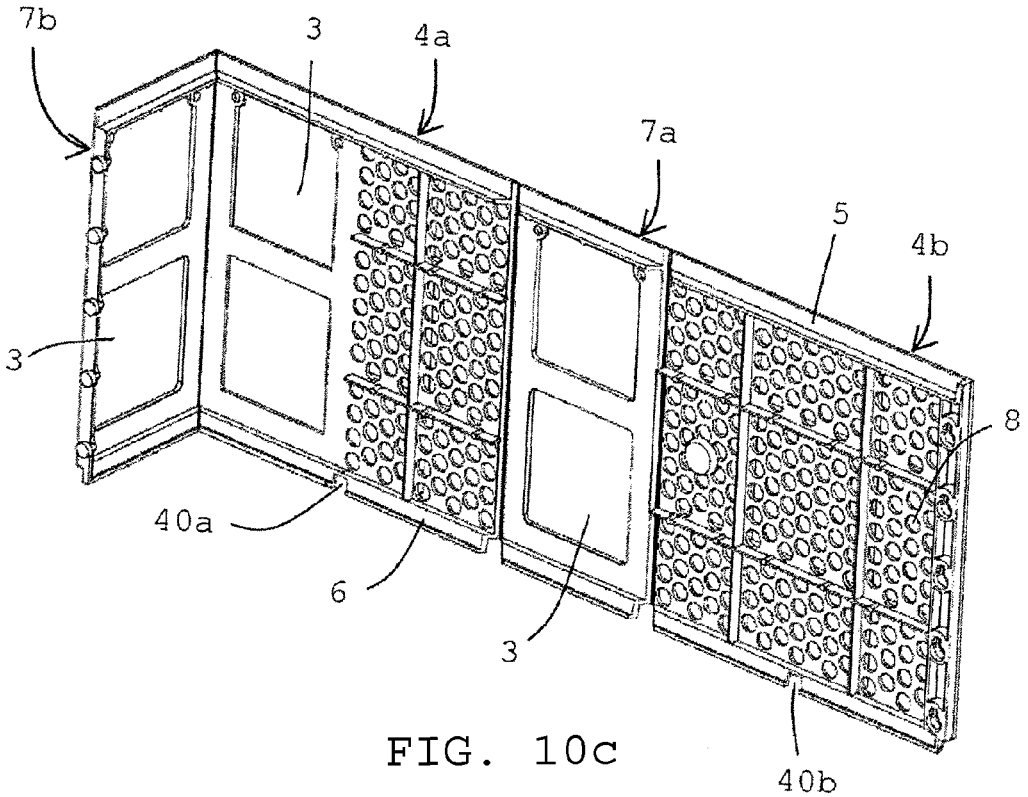
FIG. 10*c* shows a right partition element partially mounted.
Figure 10D:
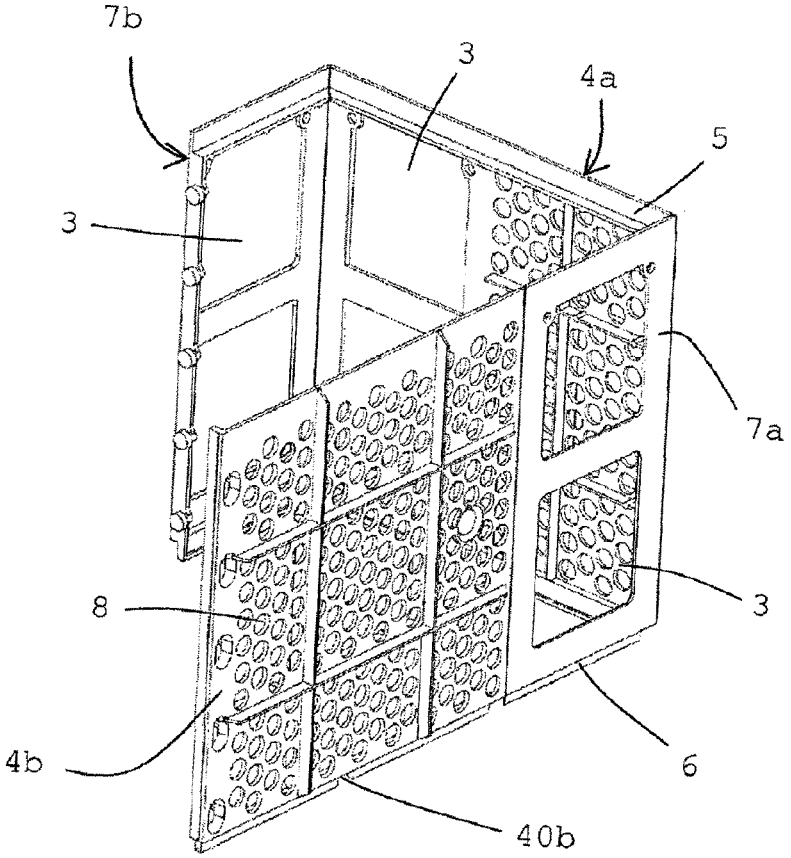
FIG. 10*d* shows a right partition element almost completely mounted.
Figure 11:
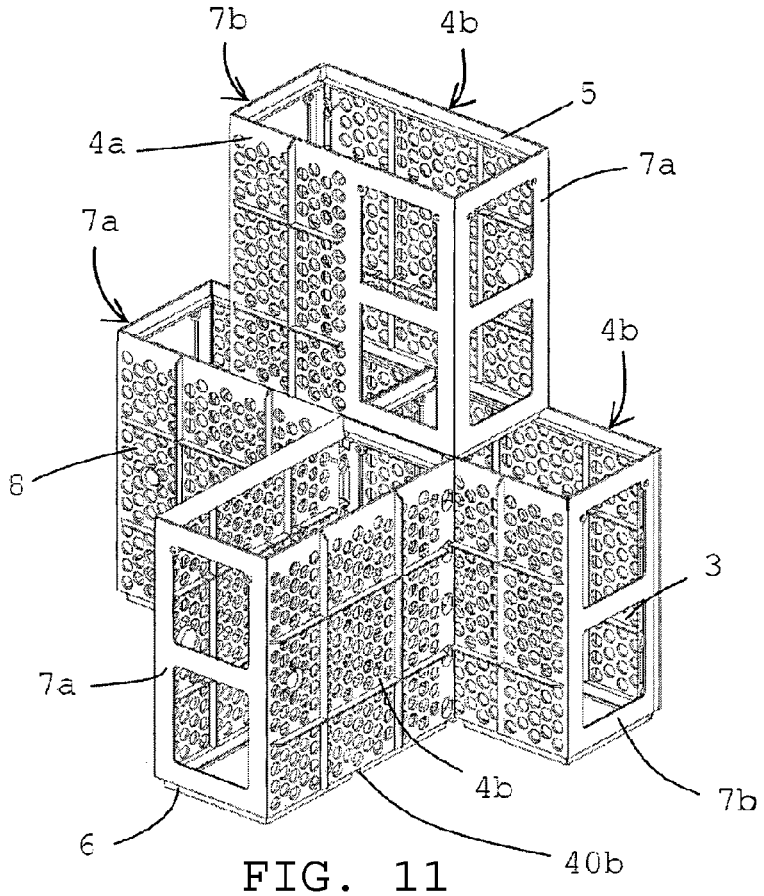
FIG. 11 shows the embodiment of a small piece of formwork, of the type used to scarf a partition in a perimetral wall, by using one right partition element, one left partition element, and two basic elements.
Figure 12A:
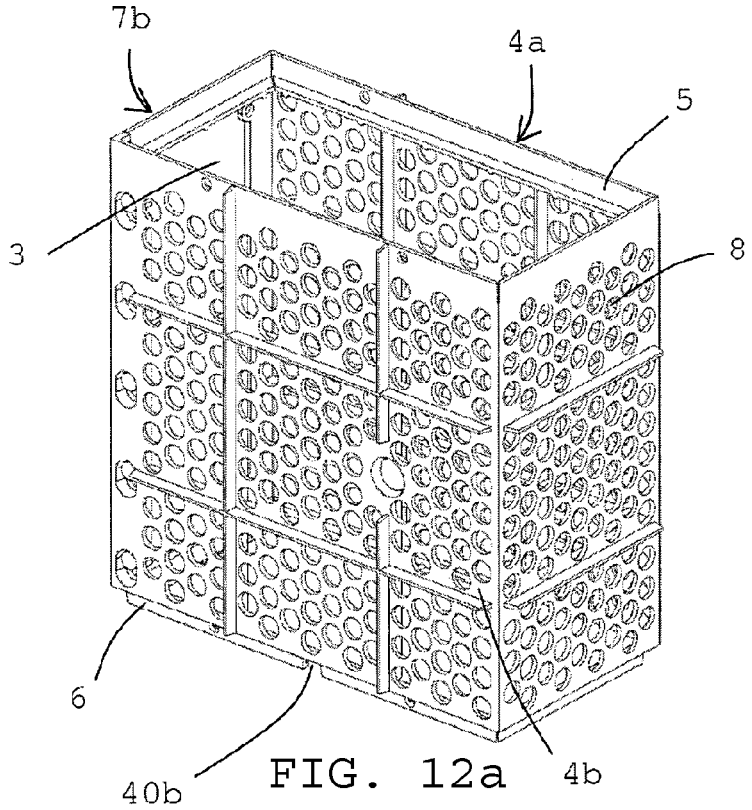
FIG. 12*a* shows a "head mould" terminal basic element consisting of one coupling side face (7*b*) and three outer side faces, hence an embodiment suitable for terminating a horizontal row; the element is shown here completely mounted.
Figure 12B:
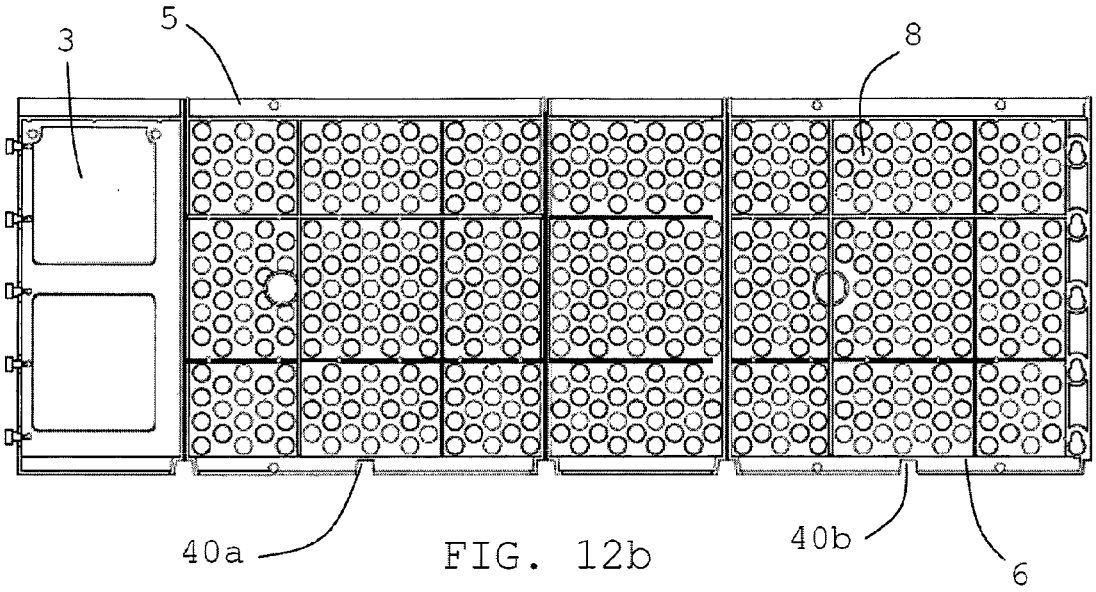
FIG. 12*b* shows a "head mould" terminal basic element fully opened, before starting its mounting.
Figure 12C:
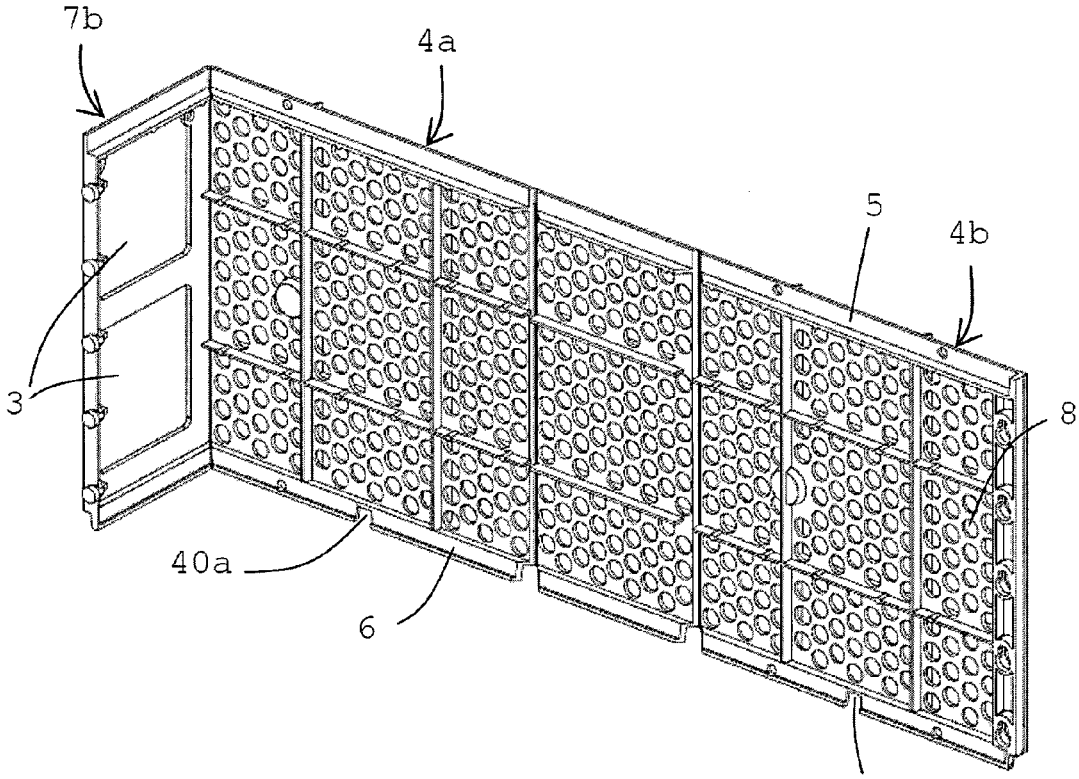
FIG. 12*c* shows a "head mould" terminal basic element partially mounted.
Figure 12D:
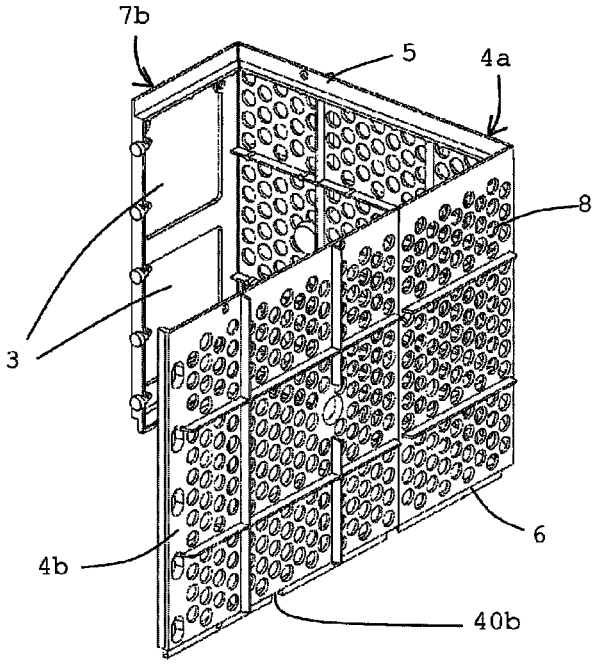
FIG. 12*d* shows a "head mould" terminal basic element almost completely mounted.
Figure 13A:
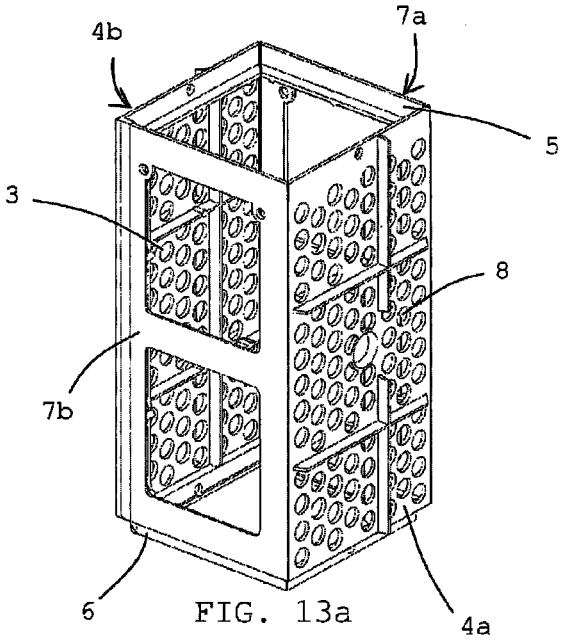
FIG. 13*a* shows a "half mould" reduced basic element having a length equal to half that of the normal basic element, used to stagger the moulds between two superimposed rows; the element is shown here completely mounted.
Figure 13B:
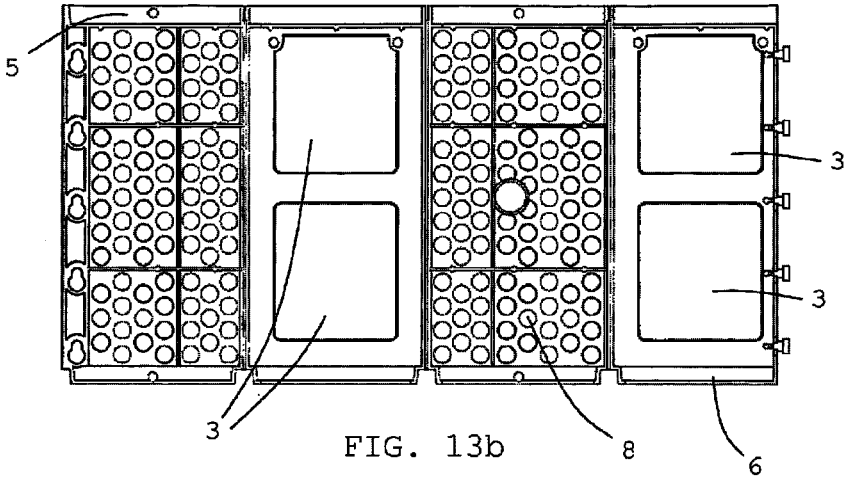
FIG. 13*b* shows a "half mould" reduced basic element completely opened, before starting its mounting.
Figure 13C:
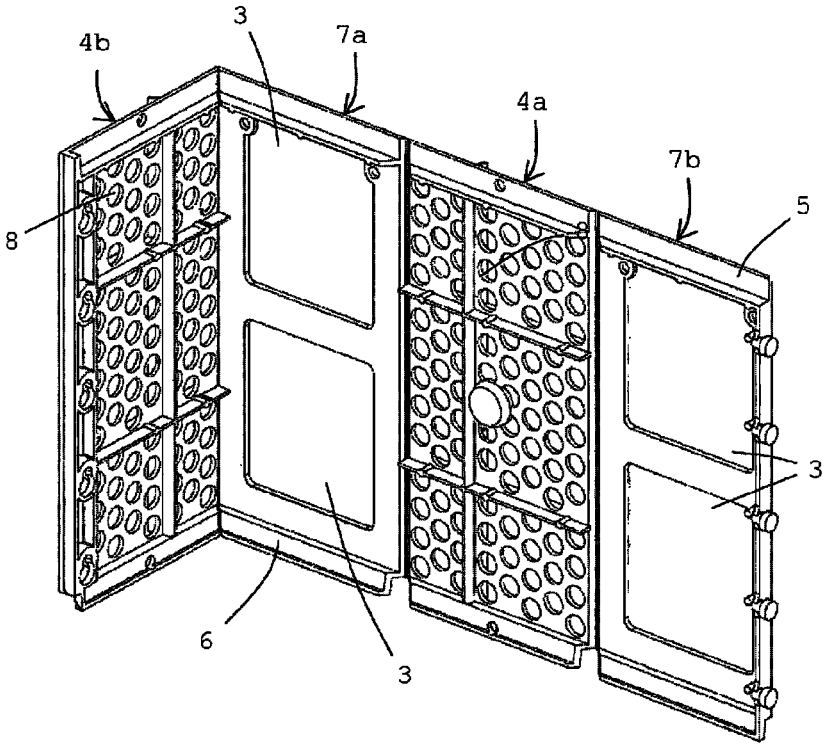
FIG. 13*c* shows a "half mould" reduced basic element partially mounted.
Figure 13D:
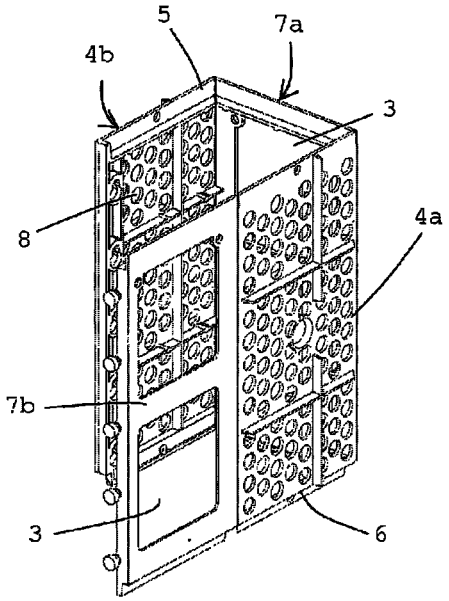
FIG. 13*d* shows a "half mould" reduced basic element almost completely mounted.
Figure 14A:
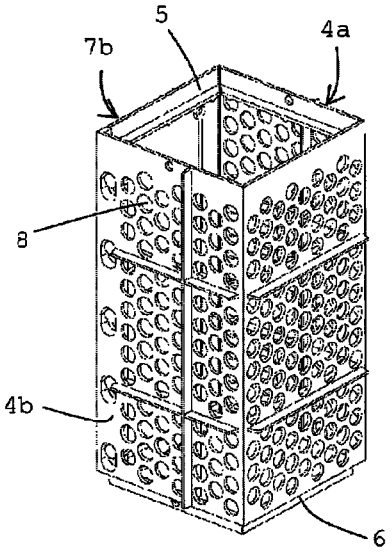
FIG. 14*a* shows a "half head mould" reduced basic element consisting of one only coupling side face and three outer side faces, hence an embodiment suitable for terminating a horizontal row; the element is shown here completely mounted.
Figure 14B:
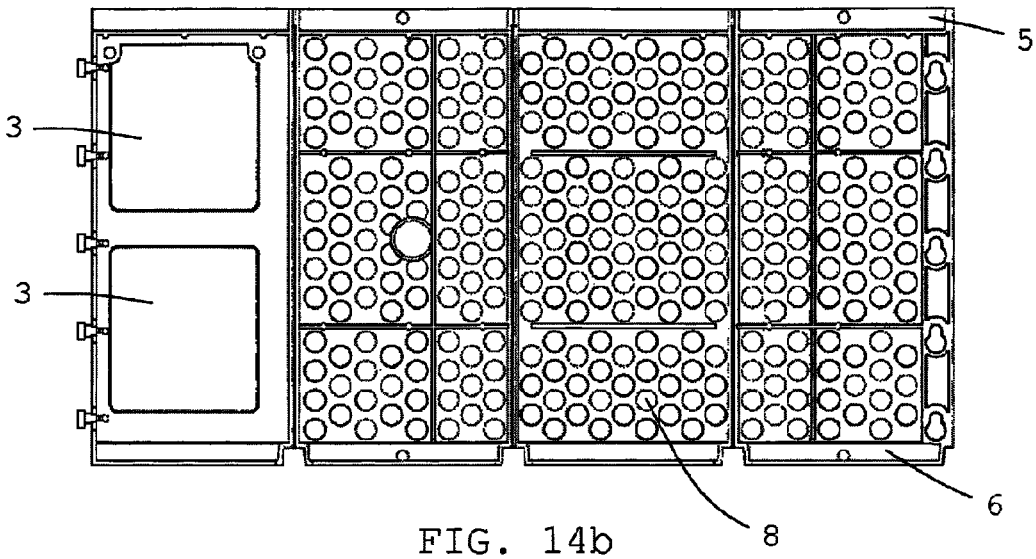
FIG. 14*b* shows a terminal "half head mould" reduced basic element completely opened, before starting its mounting.
Figure 14C:
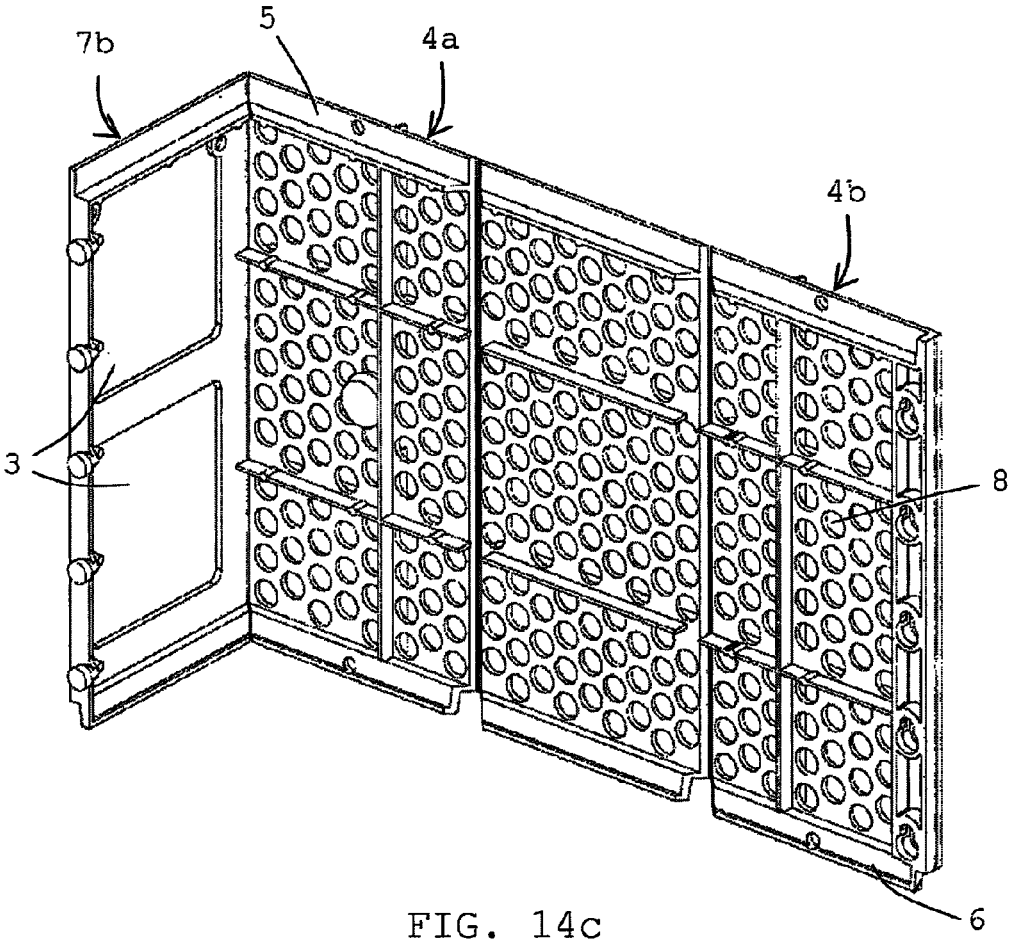
FIG. 14*c* shows a terminal "half head mould reduced basic element partially mounted.
Figure 14D:
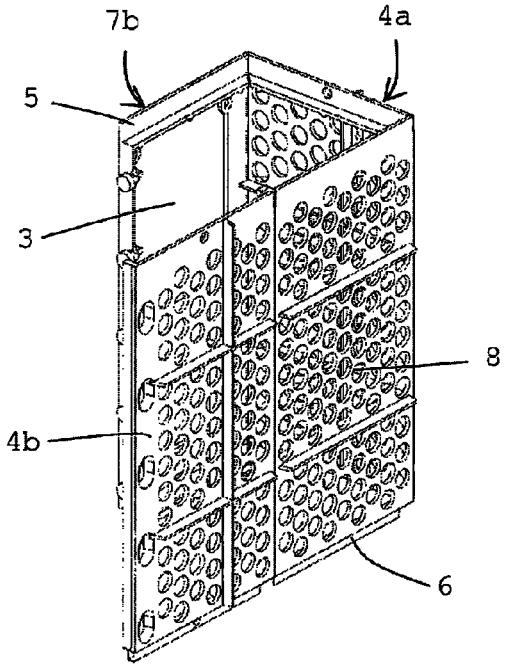
FIG. 14*d* shows a terminal "half head mould" reduced basic element almost completely mounted.
Figure 15A:
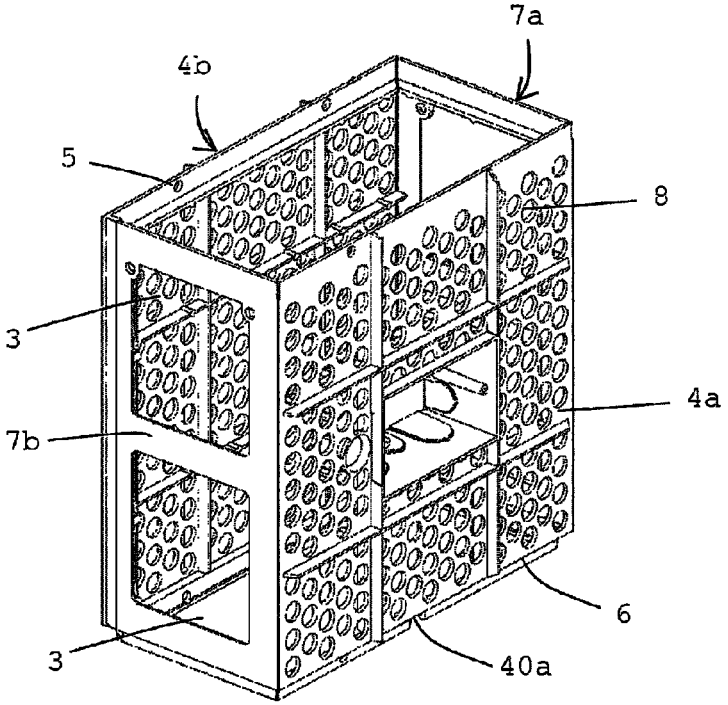
FIG. 15*a* shows a basic element modified with the addition of a box for wall-mounting electrical devices, for example switches, sockets or similar devices; the element is shown here completely mounted.
Figure 15B:
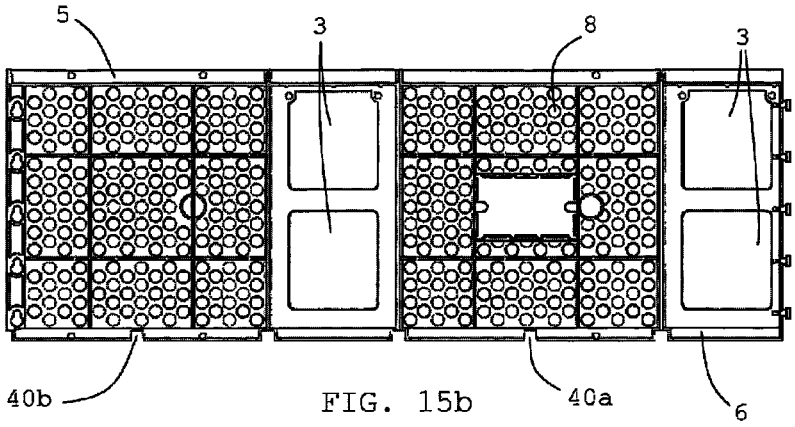
FIG. 15*b* shows a basic element modified with the addition of a box for wall-mounting electrical devices, for example switches, sockets or similar devices; the element is shown here completely opened.
Figure 15C:
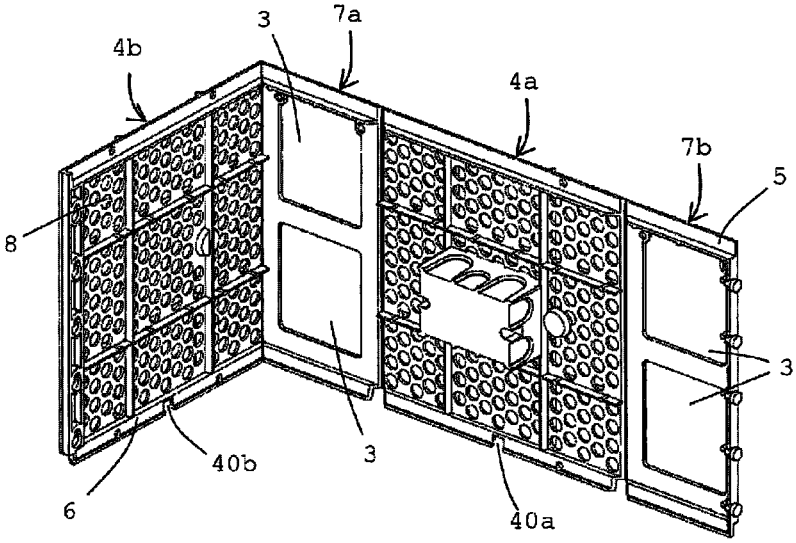
FIG. 15*c* shows a basic element modified with the addition of a box for wall-mounting electrical devices, for example switches, sockets or similar devices; the element is shown here partially mounted.
Figure 15D:
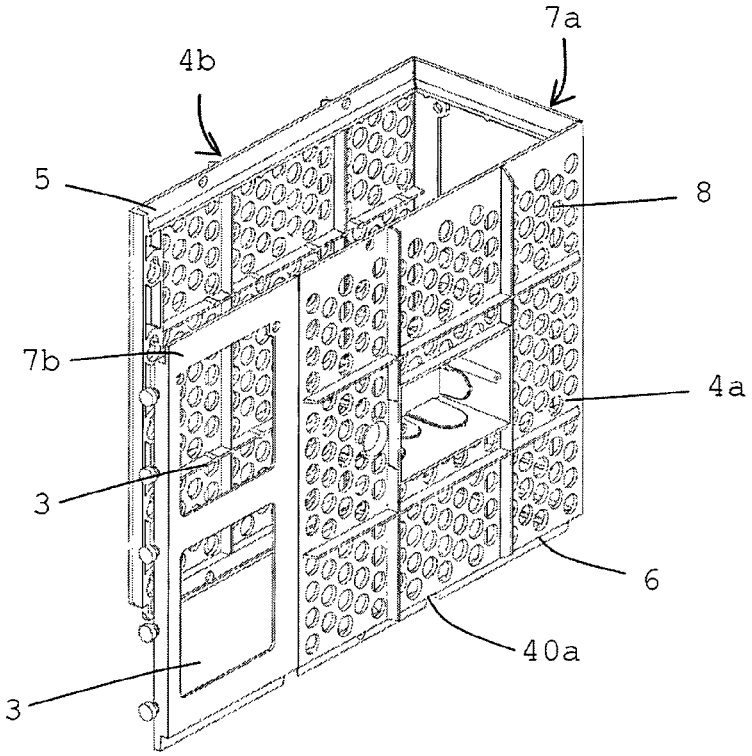
FIG. 15*d* shows a basic element modified with the addition of a box for wall-mounting electrical devices, for example switches, sockets or similar devices; the element is shown here almost completely mounted.
Figure 16A:
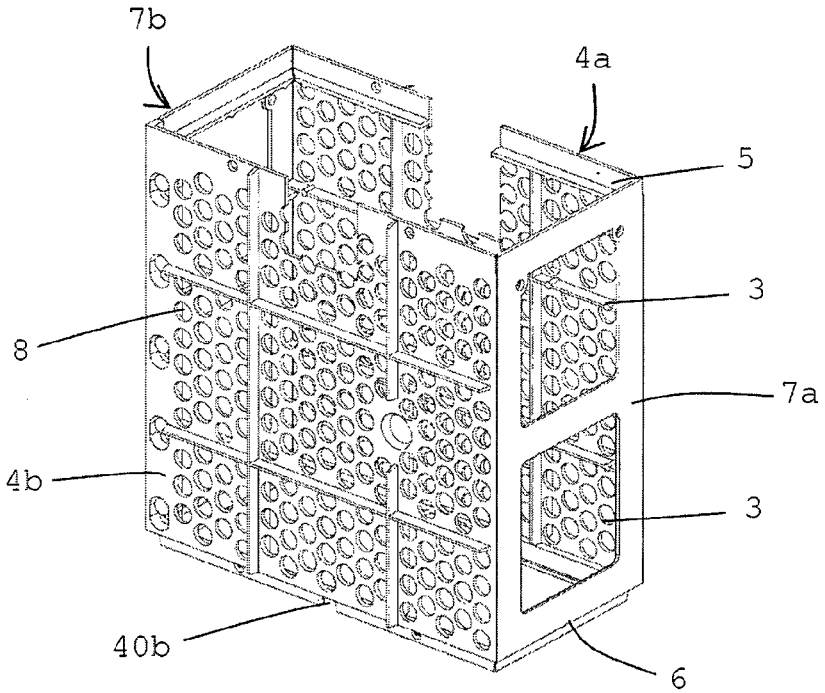
FIG. 16*a* shows a basic element modified with the addition of two spaces for receiving a covering rafter; the element is shown here almost completely mounted.
Figure 16B:
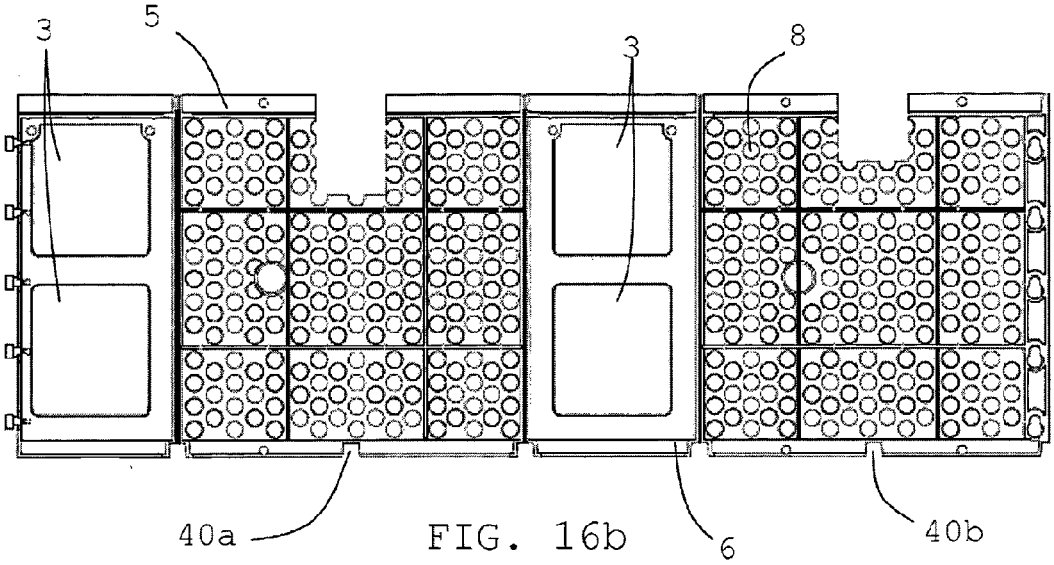
FIG. 16*b* shows a basic element modified with the addition of two spaces for receiving a covering rafter; the element is shown here completely opened.
Figure 16C:
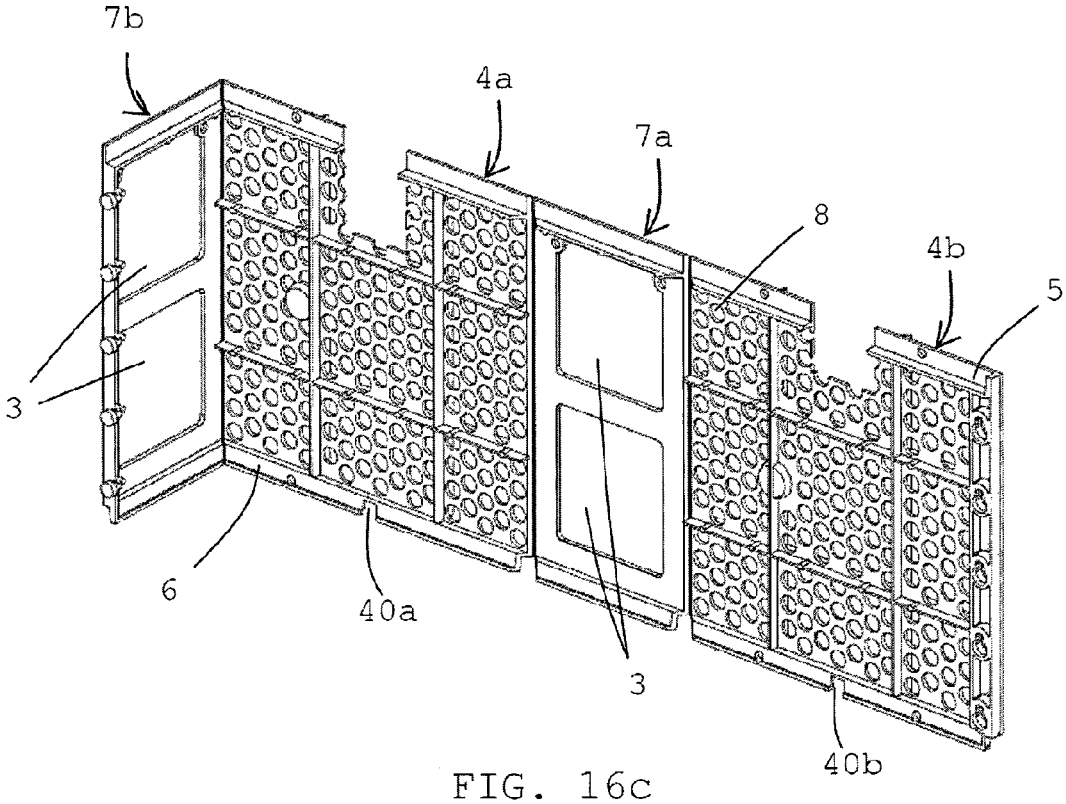
FIG. 16*c* shows a basic element modified with the addition of two spaces for receiving a covering rafter; the element is shown here partially mounted.
Figure 16D:
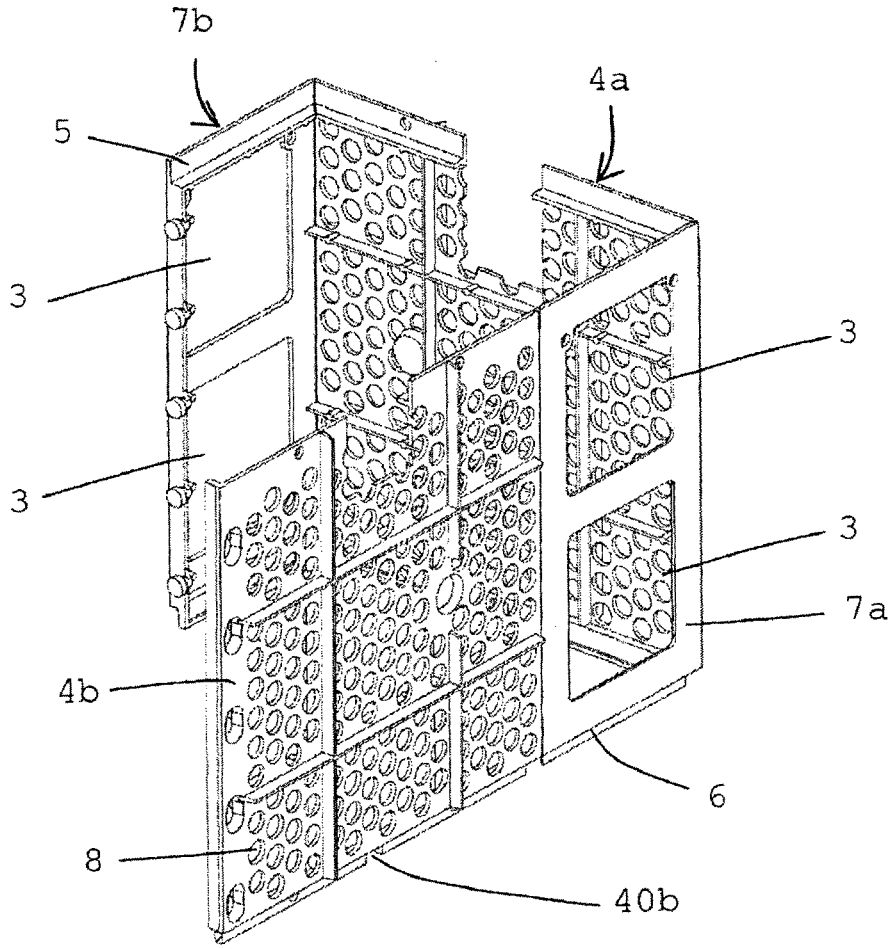
FIG. 16*d* shows a basic element modified with the addition of two spaces for receiving a covering rafter; the element is shown here almost completely mounted.

LIST OF REFERENCE CHARACTERS IN DRAWINGS openings (3) on a face or faces of the elements/moulds for doors and windows;

outer side faces (4*a*, 4*b*) of the elements/moulds;

upper means (5) and lower means (6) of the elements/moulds for vertical connection to other elements/moulds;

side coupling faces (7*a*, 7*b*) of the elements/moulds;

holes (8) on the side surfaces, from which a modest quantity of cement mixture comes out during the casting process mirror-wise cuts (40*a*, 40*b*) in sections of a foil making-up a lower male half-joint of the elements/moulds.

DETAILED DESCRIPTION OF AN EMBODIMENT OF THE INVENTION

The present invention relates to a system of disposable modular moulds for the realization of frameworks for concrete castings. In particular, the object of the present patent application consists of a plurality of modular moulds, each having a different shape and suitable for a specific function.

The system comprises a basic element, shaped as a rectangular parallelepiped and, by way of non-limiting example, one or several of the following special pieces:

- a mould for the realization of right corners, in which the second coupling face is not a head face, but is located on the right side with respect to the other coupling face;
- a mould for the realization of left corners, in which the second coupling face is not a head face, but is located on the left side with respect to the other coupling face;
- a mould comprising at least one space for accommodating electrical devices, for example switches, sockets, and similar devices;
- a right mould to realize an intersection with a partition, featuring a third coupling face on the right side;
- a left mould to realize an intersection with a partition, featuring a third coupling face on the left side;
- a half mould to trim the rows of basic moulds laid staggered;
- a head mould, with one coupling face;
- a half head mould, with one coupling face;
- a mould preset to accommodate a covering rafter.

All of these pieces are characterized by the presence of a plurality of holes on the side surfaces, from which a modest quantity of cement mixture comes out during the casting process, said modest quantity of cement mixture being spread by an operator to form a surface layer of cement material on both faces of the formwork.

In a preferred embodiment of the present invention, all types of disposable moulds are realized as elements made of plastic material, flat-molded and comprising the different faces making-up the side surface of the element, said different faces being properly connected to each other by laminar hinges.

In particular, the basic element of the system of disposable moulds is realized as a molded element made of plastic material, with a substantially flat shape, comprising the four faces of the side surface of the parallelepiped, aligned and arranged two by two, connected to each other by laminar hinges formed during the molding process.

In an advantageous embodiment of the present invention, means are provided to stiffen the connection between the different elements before the casting, for example by means of small stirrups, hooks or similar devices.

The invention claimed is:

1. System of disposable moulds for the realization of modular formworks for vertical concrete castings, comprising a basic element which is shaped as the side surface of a parallelepiped comprising two side coupling faces (7*a*, 7*b*), opposite to each other, used to mate side surfaces of other equal moulds, and two outer side faces (4*a*, 4*b*), opposite to each other, used to make-up outer faces of a formwork, said basic element comprising upper means (5) and lower means (6) for vertical connection to other moulds and one or several openings (3) on the side coupling faces (7*a*, 7*b*), so as to let cement mixture freely flow toward disposable moulds beneath and adjacent thereto, said basic element comprising, on the outer side faces (4*a*, 4*b*), a plurality of openings (3) designed to let a limited quantity of the cement mixture come out during filling casting;

said system of disposable moulds comprising:

a plurality of types of disposable moulds of different shapes, all of these being modular and designed to be assembled to each other, every type of disposable mould corresponding to a defined function, said plurality of types of disposable moulds comprising, further to the basic element, the following types of special elements:

a mould with a built-in housing for accommodating electrical devices;

a right mould comprising three coupling faces;

a left mould comprising three coupling faces; and a shaped mould shaped to accommodate a covering rafter or similar devices, said shaped mould corresponding to the basic element modified with addition of two spaces for receiving the covering rafter;

wherein each of said special elements is shaped as a side surface of a parallelepiped comprising two side coupling faces (7*a*, 7*b*), opposite to each other, and two outer side faces (4*a*, 4*b*), opposite to each other, used to make-up outer faces of the formwork, each of said special elements comprising upper means (5) and lower means (6) for the vertical connection to other moulds and one or several openings (3) on the side coupling faces (7*a*, 7*b*), so as to let the cement mixture freely flow toward the disposable moulds beneath and adjacent thereto, each of said special elements comprising, on the outer side faces (4*a*, 4*b*), a plurality of openings (3) designed to let a limited quantity of cement mixture come out during the filling casting;

wherein said right mould has a third coupling face on a right side of one of the two outer side faces of the right mould and said left mould has a third coupling face on a left side of one of the two outer side faces of the left mould;

wherein said upper means (5) of said special elements for the vertical connection of the mould to other moulds is a foil, forming an extension upwards of, the outer faces of the side surface of the mould, projecting from the outer upper perimeter and suitable for making-up an upper female half-joint;

wherein said lower means (6) of the special elements for the vertical connection of the mould to other moulds is a foil, forming an extension downwards of inner faces of the side surface of the mould, projecting in a slightly internal position with respect to the external perimeter, so as to make-up a lower male half-joint suitable for mating said upper female half-joint;

wherein said foil making-up the lower male half-joint of said basic and special elements is mirror-wise cut in sections parallel to the outer side faces (4*a* and 4*b*), so as to receive the foil of an upper female joint projecting from coupling faces of other moulds beneath and allow to connect beneath to two portions of other two moulds, thus allowing staggered mounting of the moulds or the realization of intersections between walls;

wherein each of said basic and special elements is a molded element made of plastic material, featuring a substantially flat shape, comprising the different faces of the side surface of the molded element connected to each other by laminar hinges;

wherein along two terminal edges of the molded element which will assume a vertical position after assembling the mould, locking-in facilities are arranged, which allow to join a first face and a last face to each other, so as to form a straight angle and thus close the mould;

wherein the outer side faces of each of said basic and special elements include stiffening ribs on both sides.

2. System of disposable moulds as claimed in claim 1, characterized in that said limited quantity of concrete is suitable for being spread on one or several sides of the formwork to trim it.

3. System of disposable moulds for the realization of modular formworks, as claimed in claim 1, characterized in that, in the basic element, the length of the side faces is substantially a multiple of the length of the coupling faces.

4. System of disposable moulds for the realization of modular formworks, as claimed in claim 1, characterized in that, in the basic element, each foil projecting from the outer side faces of the lower male half-joint is subdivided into at least two sections, each section having a length substantially equal to the width of the mould.

5. System of disposable moulds for the realization of modular formworks, as claimed in claim 1, further comprising means to stiffen the connection between different molded elements before the filling casting by means of small stirrups, hooks, or similar devices.

6. System of disposable moulds for the realization of modular formworks, as claimed in claim 2, characterized in that, in the basic element, the length of the side faces is substantially a multiple of the length of the coupling faces.

* * * * *